United States Patent [19]

Gerber et al.

[11] Patent Number: 4,667,553

[45] Date of Patent: May 26, 1987

[54] NOTCHING TOOL WITH PRESSER FOOT

[75] Inventors: Heinz J. Gerber, West Hartford; Claude LeBlond, Enfield, both of Conn.

[73] Assignee: Gerber Scientific, Inc., South Windsor, Conn.

[21] Appl. No.: 737,391

[22] Filed: May 23, 1985

[51] Int. Cl.[4] ..... D06H 7/00; B26D 3/14

[52] U.S. Cl. ..... 83/389; 83/49; 83/561; 83/639; 83/917; 83/925 CC; 408/100; 493/372

[58] Field of Search ..... 408/95, 97, 98, 99, 408/100, 3; 118/37; 493/61, 229, 237, 355, 370, 372; 83/917, 925 CC, 49, 389, 561, 639

[56] References Cited

U.S. PATENT DOCUMENTS

| | | | |
|---|---|---|---|
| 1,331,051 | 5/1982 | Gerber et al. | 83/925 CC X |
| 3,620,634 | 11/1971 | Sullivan | 408/95 X |
| 3,663,114 | 5/1972 | Welsh et al. | 408/3 |
| 3,752,027 | 8/1973 | Gerber et al. | 83/917 X |
| 3,797,955 | 3/1974 | Peddinghaus et al. | 408/99 X |
| 4,091,701 | 5/1978 | Pearl | 83/925 CC X |
| 4,261,285 | 4/1981 | Pearl | 118/37 |

*Primary Examiner*—Gil Weidenfeld
*Assistant Examiner*—Steven C. Bishop
*Attorney, Agent, or Firm*—McCormick, Paulding & Huber

[57] ABSTRACT

A compact notching device comprises a single piston and cylinder assembly including a piston rod, a shaft axially and rotatably mounted within the piston rod, and means for longitudinally coupling the shaft to the piston rod such that when the piston rod reciprocates, the shaft reciprocates, means for attaching an instrument in fixed relation to the shaft, means for rotating the shaft and the instrument, and a presser foot assembly mounted in fixed relation to and carried by the piston rod or the shaft.

1 Claim, 3 Drawing Figures

NOTCHING TOOL WITH PRESSER FOOT

BACKGROUND OF THE INVENTION

The invention relates generally to notching tools having presser feet and deals more particularly with a simplified form of such tools.

Notching tools of the type with which this invention is concerned are commonly used in the garment-making industry to mark pattern pieces and thereby indicate such things as the location of button holes, seams and reference points.

When used to mark pattern pieces, the tool may be installed in a cutting apparatus, mounted on a carriage adjacent a cutting device, which carriage is movable in a plane parallel to a workpiece so that the cutting device is able to cut any pattern shape and the notching tool is able to access any portion of the pattern piece.

To cut a pattern piece, the carriage is moved relative to the workpiece along a course outlining the pattern shape, and in following the course, the carriage decelerates to negotiate turns and thereafter accelerates to expedite the cutting. Because there are often many turns in the course, the carriage must accelerate and decelerate rapidly in order to provide a high cutting speed. The weight of the carriage, cutting device and notching tool, naturally limits the rate of acceleration and deceleration and the overall cutting speed.

Accordingly, a general aim of the invention is to provide a notching tool having a simple form of construction.

A more specific aim of the invention is to provide a notching tool of the foregoing type which utilizes a single piston and cylinder assembly to extend and retract an instrument and a presser foot.

Other aims and advantages of the invention will become apparent from the following description and drawings.

SUMMARY OF THE INVENTION

The invention resides in a notching device which comprises a piston and cylinder assembly including a piston and a hollow piston rod, a positioning shaft rotatably mounted within the hollow piston rod, means for longitudinally coupling the shaft to the hollow piston rod such that when the piston rod reciprocates, the shaft reciprocates, a presser foot supported by the piston rod or the positioning shaft for reciprocal movement into and out of engagement with a workpiece, means for coupling an instrument in fixed relation to the shaft and means for rotating the instrument.

DETAILED DESCRIPTION OF THE PREFERRED EMBODIMENTS

Figure 1:
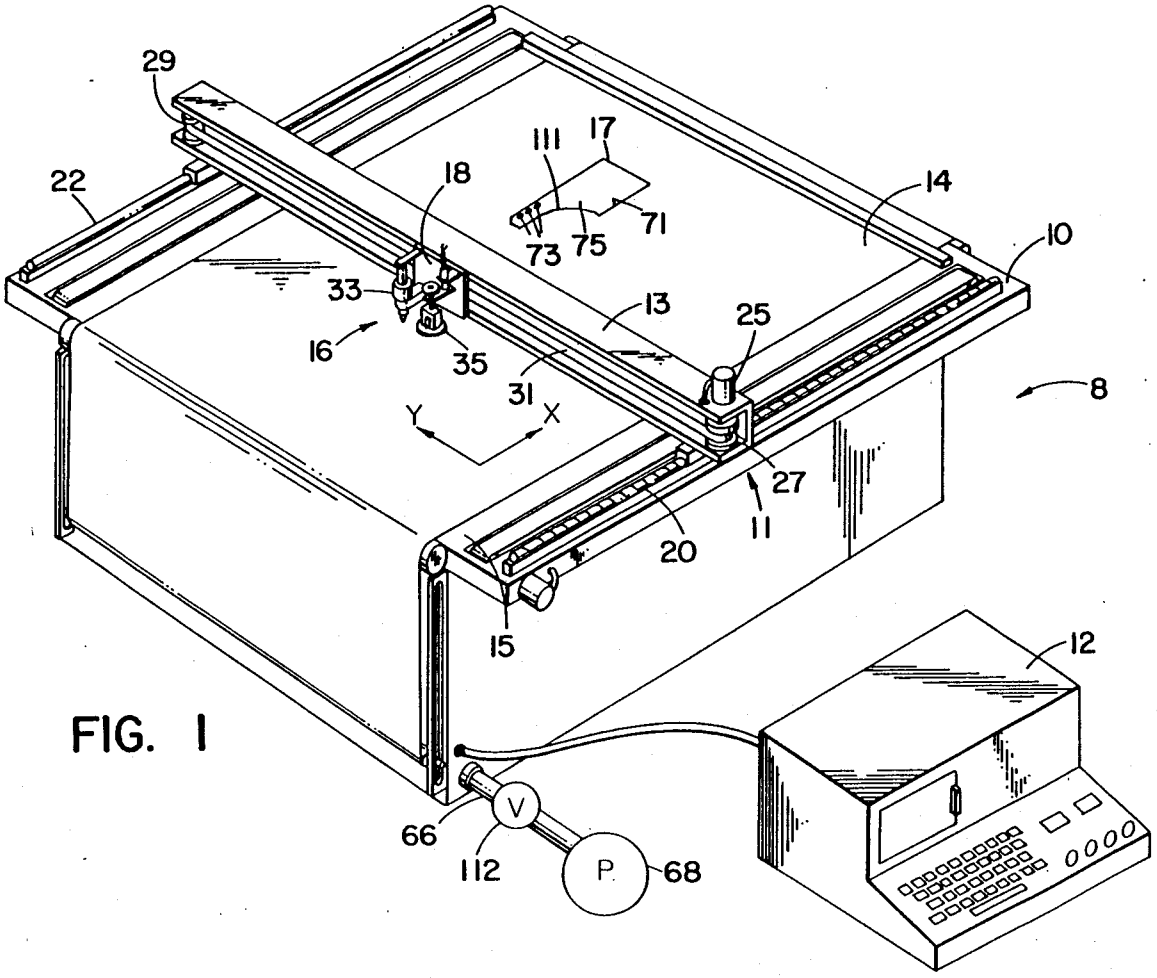
FIG. 1 is a perspective view of an automatic cutting and notching apparatus in which the invention is utilized.

FIG. 1 illustrates an automatic cutting and notching apparatus generally designated 8 in which the invention is utilized. The apparatus 8 includes a table 10 having a penetrable bed 15 which supports a worksheet 14, and a cutting and notching head 16 supported above the bed 15 for movement in a plane generally parallel thereto and a drive system 11 for moving the head. The drive system 11 includes a sliding bridge 13, a lead screw 20 threadably received by the bridge, a guide bar 22 for the bridge and a drive motor for turning the lead screw and thereby moving the head 16 in an illustrated X-coordinate direction. The drive system 11 also includes a carriage 18 which supports the head 16, a drive motor 25, a pulley 27 driven by the motor 25, a pulley 29, and a drive belt 31 supported between the pulleys 27 and 29, which belt is attached to the rear of the carriage 18 and moves it in an illustrated Y-coordinate direction. Both drive motors are controlled by a controller 12 which includes a computer programmed by a tape or disk. For a further description of an apparatus capable of moving a head such as the head 16 in a plane parallel to a work surface, reference may be made to U.S. Pat. No. 3,529,084 to Rich, issued on Sept. 15, 1970, assigned to the assignee of the present invention and hereby incorporated by reference as part of the present disclosure.

The head 16 includes a cutting device 33 and a notching tool 35, both fixedly mounted to the carriage 8. As shown more clearly in FIG. 2, the notching tool 35 comprises a piston and cylinder assembly 40, a positioning shaft 41 received within the piston and cylinder assembly 40 and reciprocated by it, a stepping motor and belt assembly 46 which rotates the shaft 41 within the piston and cyliner assembly, an instrument holding block 48 carried by and fixedly attached to the positioning shaft, an instrument 50 secured within the block, and a presser foot 52 carried by the block beneath it.

The piston and cylinder assembly 40 comprises a cylinder 53 having an upper cap 54 and a lower cap 56, a piston 58 and a hollow piston rod or sleeve 60 fixedly mounted to the piston 58 by a weld and extended upwardly and downwardly therefrom, protruding through respective apertures in the upper and lower caps of the cylinder. The cylinder 53 is fixedly mounted to the carriage 18 by a bracket 42. The piston and cylinder assembly further includes bearings 70,70 mounted to the upper and lower caps, a spring 62 mounted between the bearing 70 of the lower cap 56 and the piston 58 to retractably bias the piston and the piston rod 60, an air intake and vent port 64 coupled by a hose 66 to an air pump and regulator 68 (shown in FIG. 1). The bearings 70,70 surround and engage the piston rod 60 to accommodate axial loads caused by the reciprocation of the hollow piston rod 60 relative to the cylinder and, by way of example, take the form of linear bronze bushings. Lip seals 72,72 are received within annular recesses surrounding the piston 58, which seals allow the piston 58 to move relatively freely in the axial directions but impede rotation of the piston. The positioning shaft 41 is longitudinally secured to the piston rod 60 by two snap rings 79,79 which snap rings are received within annular recesses in the positioning shaft 41 and abut the piston rod above and below to prevent the positioning shaft from moving in either axial direction relative to the piston rod or the piston. However, the snap rings 79,79 permit the positioning shaft 41 to rotate freely within the piston rod 60.

The motor and belt assembly 46 comprises a stepping motor 80, a timing pulley 82 directly driven by the motor, a timing pulley 84 fixedly mounted to the positioning shaft 41, and a toothed or timing belt 86 coupling the two pulleys. The motor 80 is fixedly mounted by a bracket 90 to the carriage 18, so when the positioning shaft 41 is reciprocated by the movement of the piston 58 and the piston rod 60, the pulley 84 reciprocates and causes the belt 86 to deflect relative to the pulley 82 and the motor 80. By way of example, the stroke of the positioning shaft is ½ inch, the distance from the axis of the positioning shaft to the axis of the pulley 82 is 3¾ inches and the pulley 82 is mounted at a vertical level which is ¼ inch below that of the pulley 84 when the piston and piston rod are retracted and is ¼ inch above that of the pulley 84 when the piston and piston rod are extended. Hence, the maximum angle of belt deflection is small enough to maintain adequate belt coupling between the pulleys 82 and 84 and to keep the belt on the pulleys. Because the motor 80 is fixed to the carriage 18 and not moved up and down with the piston rod 60 and the positioning shaft 41, the weight on the piston 58 below is reduced and the speed at which the blade 50 may be reciprocated is increased. Also, there is less vibrational wear on the motor.

The stepping motor 80 is activated by the controller 18 to position the positioning shaft and the instrument 50 at the proper angular orientation relative to a pattern piece to yield the desired notch. As the motor 80 turns, the positioning shaft 41 rotates within the piston rod bearing against the inner lining of the piston rod. Because little rotation is required to angularly position the instrument 50, the simple bearing formed by the lining of the piston rod 60 with periodic oiling is adequate. However, if desired, bronze bushings, ball bearings or other bearings may be installed between the piston rod 60 and the associated shaft; the diameter of the associated positioning shaft being less than that of the shaft 41 to accommodate the discrete bearings.

The positioning shaft 41 is threaded at its lower end portion 91 and fixedly received within a threaded bore in the blade holding block 48 and futher secured by an adhesive such as "Locktite" made by Locktite Corporaton of Connecticut. Between the lower snap ring 79 on the shaft 41 and the block 48 is a thrust washer 91.

In the illustrated case, the instrument 50 takes the form of a notching blade secured in fixed relation to shaft 41 within an appropriately sized recess 96 in the block 48 by a set screw 98 which passes through an aperture in the blade and into a threaded bore in the block. A tip portion of the blade 50 is triangularly shaped and, in the illustrated embodiment, a vertical side 51 of the tip portion is oriented along the axis of the positioning shaft 41 to facilitate the making of a "V"-shaped notch or wedge as discussed below. The presser foot 52 is suspended from the block 48 by rods 100,100, each of which rods has a bottom portion 103 with a smaller diameter than the remaining upper portion and is threaded. The remaining upper portions of the rods 100,100 are slidably received within bores 102,102 of the block 48, and snap rings 104,104 are received within annular recesses in top portions of the rods 100,100 to prevent the rods from falling entirely through the block under their weight and that of the presser foot. The threaded bottom portions of the rods 100,100 are threadably received within the presser foot and further affixed by Locktite, and bottom end surfaces of the rods 100,100 align flushly with a bottom face of the presser foot. Each of the coil springs 106,106 surrounds the upper portion of one of the pins 100,100 and is braced at one end against the presser foot 52, received within an aperture 102 of the block 48 and braced at the other end against the interior of the block 48. The springs 106,106 bias the presser foot downward to the limit set by the snap rings when the shaft 41 and the blade 50 are retracted and to the limited set by the support bed 15 and the pattern piece 17 when the blade 50 is extended into engagement with the pattern piece. The presser foot 52 is disk shaped and includes an elongated aperture 110 beneath the blade 50. Because rods 100,100 are slidably received within bores 102,102, the longitudinal axis of aperture 110 is maintained in fixed relation to blade 50 and shaft 41.

Figure 2:
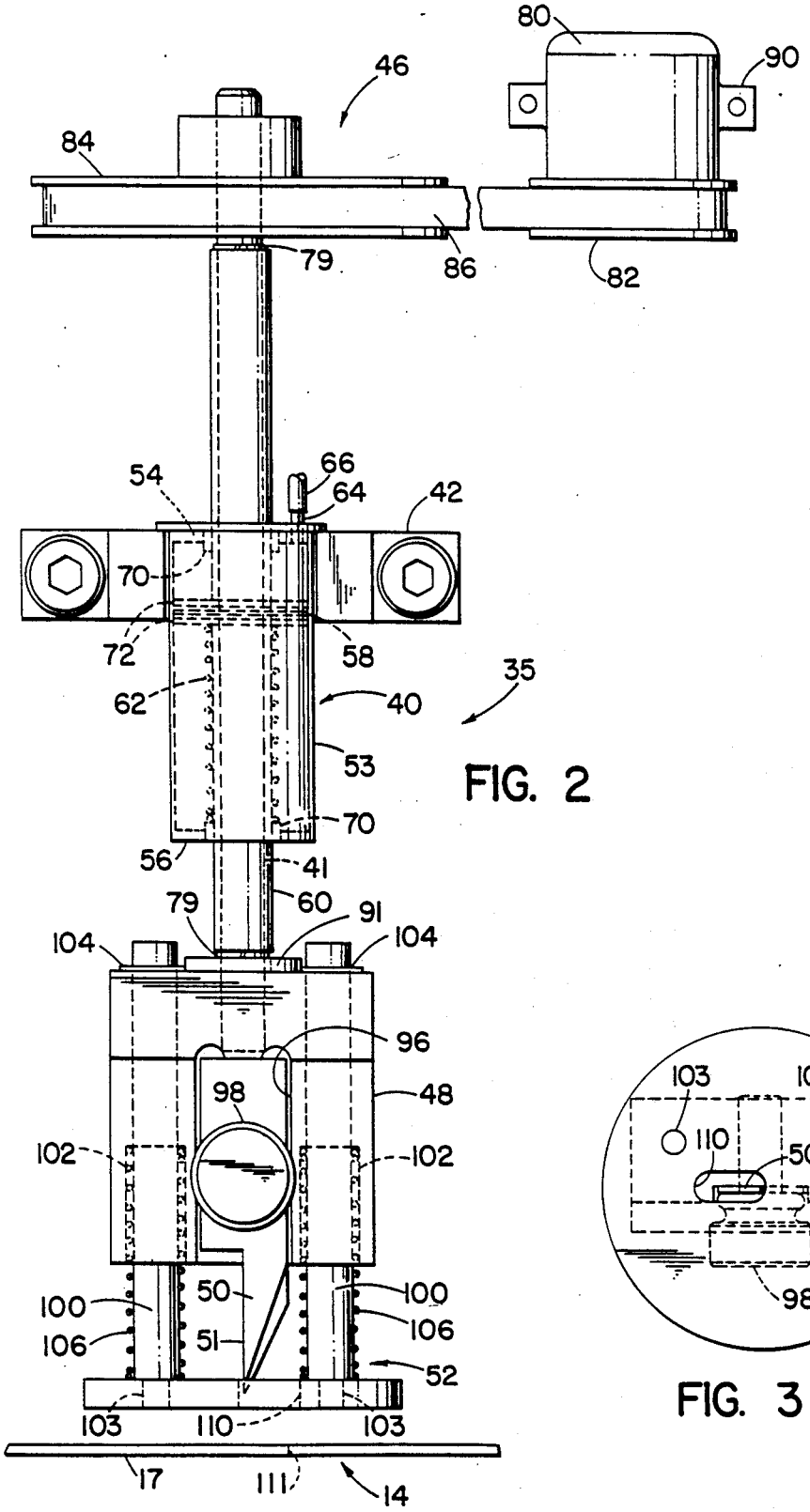
FIG. 2 is a side view of a notching tool of the apparatus of FIG. 1, which notching tool embodies the invention.
Figure 3:
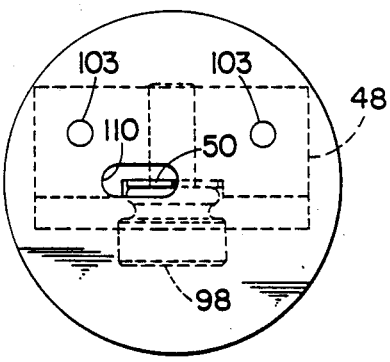
FIG. 3 is a bottom view of the notching tool of FIG. 2.

In the orientation shown in FIG. 2, the blade is in a retracted position, entirely above the bottom face of the presser foot and out of engagement with the workpiece 14. To produce a simple notch 75 on the pattern piece 17, the computer of the controller 12 directs the X-Y motors to move the notching tool 35 to a position directly above a target designated by the program tape. The computer also directs the motor 82 to rotate the shaft 41, the blade 50 and aperture 110 to the proper angular orientation. Then the computer directs a 3-way valve 112 (shown in FIG. 1) to open causing pressurized air to flow through the port 64, into the cylinder 53 and against the top face of the piston 58 to force the piston downward. Consequently, the piston rod 60 is forced downward and abuts the lower snap ring 79 and thereby transfers downward force to the shaft 41 and the block 48 causing the blade 50 and the presser foot 52 to move downward toward the workpiece. In addition, the piston rod 60 also transfers some of its downward force to the thrust washer 91 via the snap ring 79 and, the thrust washer in turn also transfers this downward force to the block 48.

Because of the bias of the spring 106, the presser foot 52 at first moves in unison with the block 48 and the balde 50 towards the workpiece 14. Then, when the presser foot contacts the workpiece 14, its downward motion is halted and the springs 106,106 being to compress. Next, the blade 50 passes through the aperture 110 in the presser foot, into engagement with the pattern piece 17 crossing an edge 111 of the pattern piece and somewhat into the penetrable bed 15 to produce a notch 75 (shown in FIG. 1). Soon afterwards,s the computer directs the valve 112 to move to a vent position at which time, the spring 62 causes the piston 58, the piston rod 60, the shaft 41, the block 48, the presser foot 52 and the blade 50 to retract, withdrawing the blade 50 from engagement with the workpiece and the bed. As the blade withdraws from engagement with the workpiece 14, the presser foot continues to press the workpiece against the support bed until the blade is fully withdrawn and located entirely above the bottom face of the presser foot and thereby helps to strip the workpiece from the blade.

If a V-shaped notch such as a notch 71 is desired, the computer then directs the motor 80 to rotate the shaft 41 and the blade 50 an appropriate mount and then re-opens the valve 112 to cause the blade to produce another notch in the manner described above, which notch joins the inboard end of the first notch because the vertical edge 51 of the blade is aligned with the axis of the positioning shaft 41. The latter notch is also angled to cross the edge 111 of the pattern piece to cut the wedge-shaped notch in a side edge portion of the pattern piece.

By the foregoing, a notching tool has been disclosed embodying the present invention. However, numerous modifications and subsitutions may be made without deviating from the spirit of the invention. For example, other types of instruments such as a standard cutting blade may be mounted to the instrument holding block 48, the stepping motor 80 used to maintain the blade tangent to a line of cut, the piston and cylinder assembly 40 used to cause the blade to engage a workpiece and the X-Y motors used to shape the cut.

Therefore, the invention has been disclosed by way of illustration and not limitation.

We claim:

1. In a machine for cutting sheet material, the combination comprising:

means providing a penetrable horizontal support surface for supporting sheet material in a spread condition, a fluid actuator supported above said support surface for movement in a plane parallel to said support surface, said actuator having a housing non-rotatable relative to said support surface, a piston contained in and reciprocable vertically relative to said housing, and a piston rod fixed to said piston for reciprocation with said piston relative to said housing, said piston rod extending downwardly from said piston through the bottom of said housing and also extending upwardly from said piston through the top of said housing, said piston having a normal raised position relative to said housing and said actuator having an operating cycle during which said piston moves downwardly from said raised position and then back again to said raised position, a positioning shaft extending axially though said piston rod, rotatably mounted within said piston rod, extending downwardly below the bottom of said piston rod and also extending upwardly above the top of said piston rod, means for vertically coupling said positioning shaft to said piston rod so that when said piston rod reciprocates relative to said housing said positioning shat reciprocates with said piston rod, a support member fixed to the lower end of said positioning shaft for rotation and reciprocation therewith relative to said housing, a presser foot carried by said support member for vertical movmement relative to said support member, said presser foot having an elongated aperture passing therethrough and having a downwardly facing pressing surface, means for biasing said presser foot downwardly relative to said support member toward a downwardly limited position relative to said support member and resiliently resisting upward movement of said presser foot relative to said support member, a knife fixed to said support member for vertical reciprocation and rotation therewith relative to said housing and having a downwardly facing elongated cutting edge located entirely above said pressing surface when said presser foot is in its downwardly limited position relative to said housing and which cutting edge moves downwardly through said elongated aperture and past and below said pressing surface when said piston is moved downwardly from said raised position relative to said housing to first bring said pressing surface into engagement with the sheet material spread on said support surface and to then move said presser foot upwardly relative to said support member to thereby cause said cutting edge to cut a slit in said sheet material and to penetrate said supporting surface, and means for establishing a desired angular position of said positioning shaft relative to said housing prior to each cycle of operation of said actuator to bring both said cutting edge of said knife and said elongated aperture of said presser foot to a corresponding angular orientation relative to the sheet material spread on said support surface so that the slit cut by said cutting edge in said sheet material will have a corresponding desired angular orientation relative to the sheet material.

* * * * *